US010266989B2

(12) United States Patent
Hanley et al.

(10) Patent No.: US 10,266,989 B2
(45) Date of Patent: Apr. 23, 2019

(54) METHODS FOR PRODUCING A CELLULOSIC FIBER HAVING A HIGH CURL INDEX AND ACQUISITION AND DISTRIBUTION LAYER CONTAINING SAME

(71) Applicant: Resolute FP US Inc., Catawba, SC (US)

(72) Inventors: Shaune Hanley, Montreal-Ouest (CA); Mark Andrews, Childersburg, AL (US); Frank Charbonneau, Barhamsville, VA (US); Gary Cothran, West Point, VA (US); Reza Amiri, Kirkland (CA); Rafik Allem, Pointe-Claire (CA); Waleed Wafa Al Dajani, Pierrefonds (CA)

(73) Assignee: Resolute FP US Inc., Catawba, SC (US)

( * ) Notice: Subject to any disclaimer, the term of this patent is extended or adjusted under 35 U.S.C. 154(b) by 0 days.

(21) Appl. No.: 15/088,356

(22) Filed: Apr. 1, 2016

(65) Prior Publication Data

US 2016/0289895 A1 Oct. 6, 2016

Related U.S. Application Data

(60) Provisional application No. 62/142,575, filed on Apr. 3, 2015.

(51) Int. Cl.

| | |
|---|---|
| ***D21C 9/18*** | (2006.01) |
| ***D21C 9/00*** | (2006.01) |
| ***D21H 15/04*** | (2006.01) |

(52) U.S. Cl.

CPC ..... *D21C 9/005* (2013.01); *D21C 9/002* (2013.01); *D21C 9/007* (2013.01); *D21C 9/18* (2013.01); *D21H 15/04* (2013.01)

(58) Field of Classification Search

CPC ..... D21C 9/00; D21C 9/005; D21C 9/002; D21C 9/007; D21C 9/18; D21H 15/04

USPC ..... 162/9

See application file for complete search history.

(56) References Cited

U.S. PATENT DOCUMENTS

| | | | |
|---|---|---|---|
| 2,260,513 | A | 10/1941 | Deile et al. |
| 2,516,384 | A | 7/1950 | Hill et al. |
| 3,145,075 | A | 8/1964 | Ernst et al. |
| 3,190,716 | A | 6/1965 | Gordon et al. |
| 3,224,926 | A | 12/1965 | Bernardin et al. |
| 3,627,630 | A | 12/1971 | Gagnon |
| 4,431,479 | A | 2/1984 | Barbe et al. |
| 4,888,093 | A | 12/1989 | Dean et al. |
| 4,898,642 | A | 2/1990 | Moore et al. |
| 4,954,221 | A | 9/1990 | Reinhall et al. |
| 5,137,537 | A | 8/1992 | Herron et al. |
| 5,147,345 | A | 9/1992 | Young et al. |
| 5,183,707 | A | 2/1993 | Herron et al. |
| 5,190,563 | A | 3/1993 | Herron et al. |
| 5,225,047 | A | 7/1993 | Graef et al. |
| 5,549,791 | A | 8/1996 | Herron et al. |
| 5,562,740 | A | 10/1996 | Cook et al. |
| 5,749,836 | A | 5/1998 | Payne |
| 5,749,863 | A | 5/1998 | Payne |
| 5,858,021 | A | 1/1999 | Sun et al. |
| 5,873,979 | A | 2/1999 | Naieni |
| 5,998,511 | A | 12/1999 | Westland et al. |
| 6,413,362 | B1 | 7/2002 | Hu |
| 6,464,826 | B1 | 10/2002 | Safstrom et al. |
| 6,562,743 | B1 | 5/2003 | Cook et al. |
| 6,620,293 | B2 | 9/2003 | Sears et al. |
| 6,620,865 | B2 | 9/2003 | Westland et al. |
| 6,689,461 | B2 | 2/2004 | Koyanagi et al. |
| 6,770,576 | B2 | 8/2004 | Cook et al. |
| 6,780,201 | B2 | 8/2004 | Sun et al. |
| 6,899,790 | B2 | 5/2005 | Lee |
| 6,984,447 | B2 | 1/2006 | Hu et al. |
| 6,986,793 | B2 | 1/2006 | Stoyanov et al. |
| 7,018,511 | B2 | 3/2006 | Sears et al. |
| 7,094,318 | B2 | 8/2006 | Hamed et al. |
| 7,195,695 | B2 | 3/2007 | Sears et al. |
| 7,320,740 | B2 | 1/2008 | Hamed et al. |
| 7,334,347 | B2 | 2/2008 | Mann et al. |
| 7,364,639 | B2 | 4/2008 | Hu et al. |
| 7,419,568 | B2 | 9/2008 | Hamed et al. |

(Continued)

FOREIGN PATENT DOCUMENTS

| | | | |
|---|---|---|---|
| CA | 2035402 | A1 | 8/1991 |
| EP | 0440472 | B1 | 8/1991 |
| WO | 2007073342 | A1 | 6/2007 |

OTHER PUBLICATIONS

International Search Report and Written Opinion for related International Application No. PCT/US2016/025462 dated Jun. 23, 2016.

(Continued)

*Primary Examiner* — Mark Halpern

(74) *Attorney, Agent, or Firm* — Troutman Sanders LLP; James E. Schutz; Alexis N. Simpson

(57) ABSTRACT

A process for producing cellulosic fiber with a high curl index is disclosed. The process can include mechanically treating and chemically crosslinking kraft pulp. The mechanical treatment of the pulp can include convolving and mechanically treating a pulp at in a plug screw and steam tube at temperatures above 100° C. and pressures above 3 bar. The mechanically treated pulp can be crosslinked with a crosslinking agent. The product fiber can exhibit a curl index of greater than 0.35, and can be at least 50% higher than the initial curl of the starting pulp material.

19 Claims, 9 Drawing Sheets

(56) References Cited

U.S. PATENT DOCUMENTS

| | | | |
|---|---|---|---|
| 7,892,400 | B2 | 2/2011 | Sabourin |
| 8,277,606 | B2 | 10/2012 | Lee |
| 2001/0020520 | A1 | 9/2001 | Hu et al. |
| 2001/0040015 | A1 | 11/2001 | Lee |
| 2003/0192659 | A1 | 10/2003 | Yancey et al. |
| 2005/0051286 | A1 | 3/2005 | Carels et al. |
| 2005/0145348 | A1 | 7/2005 | Lee |
| 2005/0247419 | A1 | 11/2005 | Hamed et al. |
| 2006/0144541 | A1 | 7/2006 | Joy Nickel et al. |
| 2007/0254550 | A1 | 11/2007 | Hamed et al. |
| 2007/0270070 | A1 | 11/2007 | Hamed |
| 2009/0227975 | A1 | 9/2009 | Dougherty, Jr. et al. |
| 2011/0077354 | A1 | 3/2011 | Stoyanov et al. |
| 2012/0004406 | A1 | 1/2012 | Stoyanov et al. |

OTHER PUBLICATIONS

Supplementary European Search Report and Opinion dated Aug. 3, 2018, 6 pages.

METHODS FOR PRODUCING A CELLULOSIC FIBER HAVING A HIGH CURL INDEX AND ACQUISITION AND DISTRIBUTION LAYER CONTAINING SAME

CROSS-REFERENCE TO RELATED APPLICATIONS

This application, filed Apr. 1, 2016 under 35 U.S.C. § 119(e), claims the benefit of U.S. Provisional Patent Application Ser. No. 62/142,575, filed Apr. 3, 2015, entitled "Methods for Producing a Cellulosic Fiber Having a High Curl Index and Acquisition and Distribution Layer Containing the Same," the entire contents and substance of which are hereby incorporated by reference as if fully set forth below.

TECHNICAL FIELD

The various embodiments of the disclosure relate generally to processes and methods for preparing, and compositions containing, a high curl kraft fiber. The process includes a combination of mechanical treating and chemical crosslinking to achieve a high curl index in the kraft pulp fiber. The high curl fiber can be used in a variety of materials needing high loft under wet or dry conditions, including absorbent materials.

BACKGROUND

The conversion of plant and tree materials to pulp has been a long and well known process for centuries. Numerous processes and systems are known, including for example mechanical processes, chemical processes such as the Kraft process, chemi-mechanical processes, thermo-mechanical processes, and other processes known to those of skill in the art. One value that is measured in the preparation of cellulosic fibers is the curl index. An increase in curl is generally used to indicate an increase in the bulk and absorbency of materials made with the curly fiber.

The goal for producing higher curl index values in pulp processes has been disclosed in several patents. For example, U.S. Pat. No. 6,899,790 involves creating a curly fiber by treating a pulp in a disk refiner at elevated temperatures and pressures. The '790 patent includes shearing the pulp at elevated temperatures and pressures while the pulp is in the refining gap between two plates of a disk refiner. U.S. Pat. No. 7,390,378 discloses treating a fiber under pressure and in the presence of steam in a rotating drum, which batch processes fiber in an enclosed rotating drum. Both patents rely on a thermo-mechanical treatment to convolve the fiber and to produce a higher curl index.

BRIEF SUMMARY

The various embodiments of the disclosure relate to high curl kraft pulps, and methods of making the high curl pulps. An embodiment of the disclosure can be a process for preparing the high-curl kraft pulp. The process can include the steps of mechanically treating a chemical pulp by passing the pulp through a plug screw, passing the pulp through a steam tube in less than about 6 minutes, and pressurizing the pulp while in the plug screw with steam at a temperature above 100° C. and a pressure greater than 2 bar. The mechanically processed pulp can be treated with a crosslinking agent, dried at a temperature above 100° C.; and cured at a temperature of at least about 140° C. to produce the high-curl pulp.

In an embodiment, the pulp can be at a pressure of greater than 3 bar, or at a pressure of 3 to 5 bar. The pulp can reside in the steam tube for 30 seconds to 5 minutes, for about 30 seconds to 4 minutes, or for about 2 to 4 minutes. The pulp can be at a pressure of 3-5 bars at a temperature greater than 100° C. for 30 seconds to 4 minutes.

The disclosure can also include a process for preparing a high curl kraft pulp, and/or a high curl crosslinked kraft pulp, where the process includes mechanically treating a chemical pulp, treating the mechanically treated kraft pulp with a crosslinking agent, drying the crosslinked kraft pulp at a temperature above 100° C., and curing the crosslinked kraft pulp at a temperature of at least about 140° C. to produce the high-curl pulp.

In an embodiment of the disclosure, the crosslinking agent can be citric acid or glutaraldehyde. The crosslinking agent can be at 0.5-10% by weight to the kraft pulp solids, or at 1-5% by weight of the solids. The crosslinking agent can be citric acid at 0.5-10% by weight of the pulp solids, or 1-5% by weight.

In an embodiment of the disclosure, the curing step can be conducted at greater than about 140° C., or greater than about 150° C., or greater than about 160° C.

In an embodiment of the disclosure, the process can produce a high curl pulp. The high curl kraft pulp can have a curl index of at least about 0.35, greater than about 0.40, or at least about 0.45. The final curl index can be at least 100% higher than the curl index of the initial pulp, or at least 150% higher, or at least 200% higher.

In an embodiment of the disclosure, the process can also produce a product that can be included in absorption layers, include acquisition and distribution layers (ADL.) The absorption layer or the ADL can include a crosslinked processed kraft pulp fiber, or a citric acid crosslinked kraft pulp fiber. The fiber can have a curl index of at least 0.40, at least about 0.42, at least about 0.45, or at least about 0.48. The absorption layer or the ADL can include at least about 1% citric acid by weight of pulp, or at least about 3% citric acid. The absorption layer or the ADL can include at least about 1% citric acid by weight and have a curl index of at least about 0.45.

DETAILED DESCRIPTION

Figure 1:
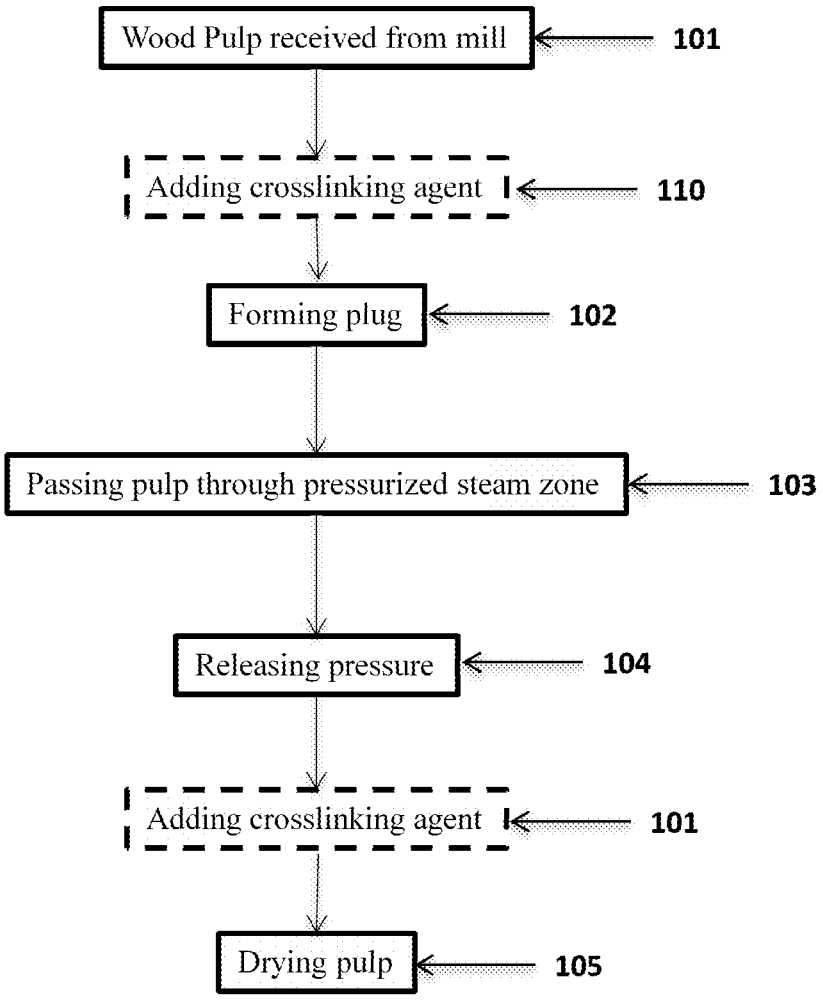
FIG. 1 illustrates a flow chart of the process in accordance with some embodiments of the disclosure.

Although preferred embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. The disclosure is capable of other embodiments and of being practiced or carried out in various ways. Also, in describing the preferred embodiments, specific terminology will be resorted to for the sake of clarity.

It must also be noted that, as used in the specification and the appended claims, the singular forms "a," "an" and "the" include plural referents unless the context clearly dictates otherwise.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges can be expressed herein as from "about" or "approximately" one particular value and/or to "about" or "approximately" another particular value. When such a range is expressed, another embodiment includes from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

The disclosure includes a process for preparing a high-curl kraft pulp. The process can include the steps of mechanically processing a chemical pulp, treating the mechanically processed pulp with a crosslinking agent, and drying the mechanically treated crosslinked pulp.

The process steps can be represented graphically as a series of steps conducted with a pulp. In FIG. 1, a chemical pulp received from a mill 101 can be passed through a plug screw 102. A crosslinking agent can be added to the chemical pulp 110 either at a step prior to the pulp passing through the plug screw, at a step later in the process after the plug screw, or at both points. After the chemical pulp passes through the plug screw, the pulp can next be passed through a pressurized steam zone 103. Step 103 and step 102 can be performed in separate steps, can be performed at the same time, or can at least partially overlap with each other. During step 102 and optionally including step 103, the pulp is mechanically treated, for example in a plug screw, to introduce curl into the fiber. After the pulp passes through the steam pressure step 103, the pressure can be released in step 104. The pulp can then be dried and/or cured in a later step 105 to produce a dried product.

Figure 2:
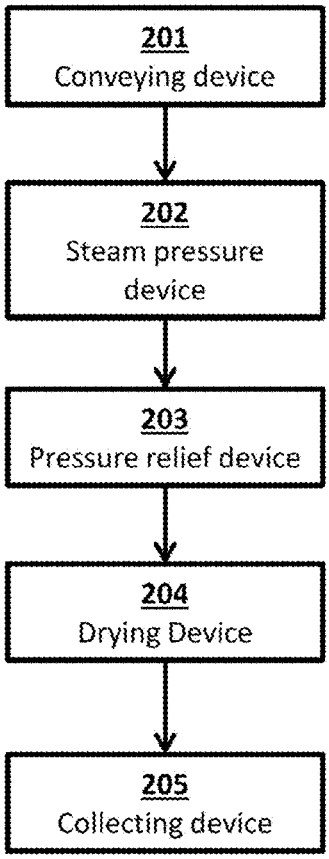
FIG. 2 illustrates a flow chart of the process in accordance with some embodiments of the disclosure.

The process steps can also be represented graphically by devices at which the steps can occur. In FIG. 2, a chemical pulp can enter the process by conveying device 201. The conveying device 201 can be any device that forms a plug of the pulp in the process. One example of a conveying device 201 can be a plug screw. The pulp can be fed via the conveying device 201 into a steam pressure device 202. The steam pressure device can be, for example, a steam tube. The conveying device 201 and the steam pressure device 202 need not be separate pieces of equipment, but could instead be a single piece having a structure that conveys the pulp to form a plug which is also heated and pressurized during plug formation and conveying. The combination of conveying device 201 and steam pressure device 202 can lead to mechanical treatment of the pulp. The plug of pulp can exit the steam pressure device 202 via a pressure release device 203. Once the pulp exits the pressure release device 203, it can move on to a drying and/or curing device 204 and eventually to a collecting device 205. Alternatively, the pulp could be dried, collected, such as on an air-laying device, and then subsequently cured. The pulp can be treated with a crosslinking agent at several points in the process, including between the pressure release device 203 and the drying device 204, prior to the conveying device 201, or within the conveying device.

Figure 3:
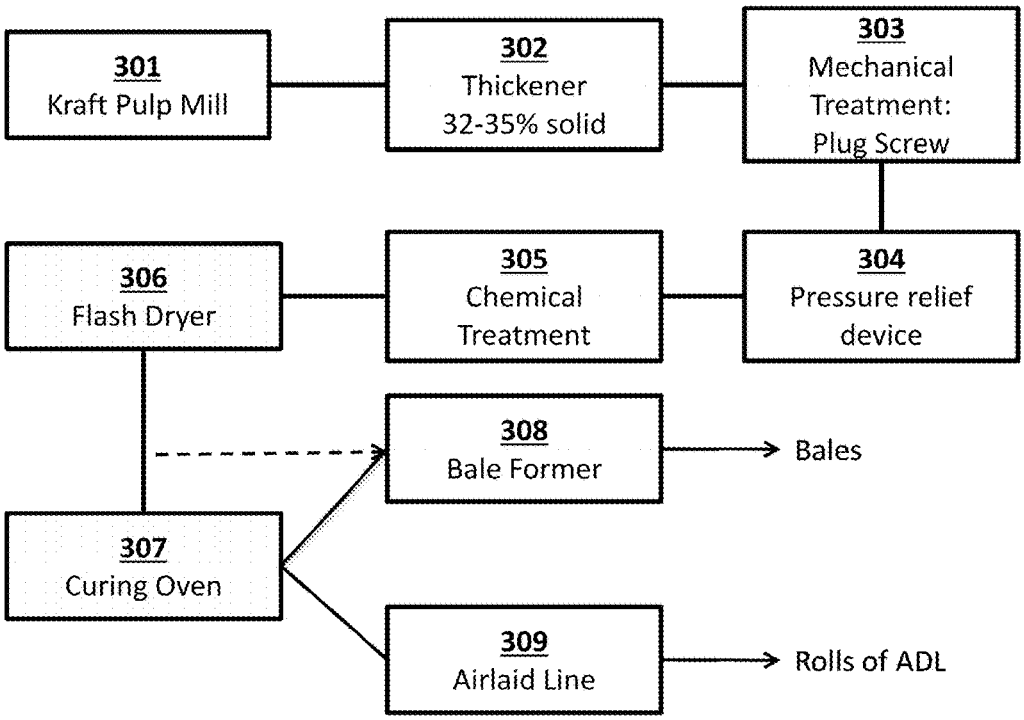
FIG. 3 illustrates a flow chart of the process in accordance with some embodiments of the disclosure.

In a non-limiting example, a diagram of the process can be shown as in FIG. 3. In FIG. 3, chemical pulp 301 from a kraft mill can be dewatered in a thickener 302 to a solids concentration of 32-35 wt % solids, and fed into a plug screw 303 for mechanical treatment, which can be under steam pressure. The pressure from the plug screw can be released via a pressure release device 304 and can undergo chemical treatment 305 prior to entering a flash dryer 306. The product from the flash dryer can enter a curing oven 307, and then pass to a bale former 308 for producing bales, or to an airlaid line 309 or similar unit, to produce airlaid items such as rolls of ADL, material for filters, insulation, napkins, etc. Alternatively, the product from the flash dryer can also pass directly to the bale former 308 for producing bales for later applications. For example, bales prepared directly from the flash dryer can be later processed with additional materials and subsequently cured. As another alternative, the product from the dryer can be "wet laid" to form a web-based product which can be subsequently dried.

In an embodiment of the disclosure, a pulp can be a pulp received from a pulping mill, including the liquid, usually water, that contains the pulp. The pulp can be a fibrous pulp. The pulp can be from rice, wood, straw, switch grass, or other fibrous sources. Preferably the pulp is a wood pulp, preferably a chemical pulp from wood, more preferably a chemical pulp from softwood. The pulp can be a chemical or mechanical pulp, preferably a chemical pulp. The solids content of the pulp can be from about 1% to about 60% solids, from about 10% to about 50% solids, or from about 20% to about 45% solids, by weight. Pulp received directly from a mill can be about from about 1 wt % to about 20 wt % solids, usually 5 wt % to about 20 wt % solids. The pulp can be dewatered prior to processing to increase the solids content of the pulp. The dewatered pulp can be about 20 wt % to about 55 wt % solids, including at least about 25 wt %, at least about 30 wt %, or at least about 35 wt %.

In the disclosure, mechanically processing the pulp can be conducted in a plug screw and a steam tube. In the process, the pulp can be processed by passing through a plug screw and steam tube. The pulp being fed into the plug screw forms a plug of pulp, and the pulp is pushed through the steam tube by the mechanical action of the plug screw. The pulp can exit the plug screw and steam tube after a sufficient residence time. The pulp can exit via any typical device that relieves pressure, including for example, equipment that has a pressure relief valve, a blow valve, a disintegrator operating at atmospheric pressure, or a disk refiner operating at atmospheric pressure.

The residence time of the pulp in the plug screw and steam tube can be less than 15 minutes, typically be less than 10 minutes. In an embodiment, the residence time can be less than about 9 minutes, less than about 8 minutes, less than about 7 minutes or less than about 6 minutes. In some embodiments, the residence time in the plug screw and steam tube can be between about 30 seconds and about 6 minutes, between about 30 seconds and about 5 minutes, between about 30 seconds and about 4 minutes, or between about 2 and about 4 minutes.

The mechanical action of the plug screw can apply pressure to the pulp, as well as increasing the heat of the pulp by both mechanical action and pressurization. The pulp can also undergo heating and pressurization in the steam tube. In an embodiment, the pulp can be heated in the steam tube at a temperature of at least about 100° C., at least about 110° C., at least about 120° C., or at least about 140° C. In some embodiments, the pulp can be heated in the steam tube at a temperature of about 100° C. to about 200° C., 100° C. to about 180° C., or 100° C. to about 160° C.

The steam tube can also include a pressure for the steam in the tube. In an embodiment, the pulp can be pressurized to a pressure greater than 1 bar, greater than 1.5 bars, greater than 2 bars, or greater than 3 bars. In an embodiment, the pressure can be from about 2 bars to about 6 bars, from about 3 bars to about 5 bars, or from about 3 bars to about 4 bars.

The mechanical processing of the pulp can be controlled by the overall time and conditions that the pulp is exposed to. The pulp can be both heated and pressurized by steam in the steam tube over a period of time. In an embodiment, the pulp can be at a pressure of greater than 2 bars at a temperature of greater than 100° C. for 30 seconds to 6 minutes. In an embodiment, the plug can be at a pressure of 3 to 5 bars at a temperature of greater than 100° C. for 30 seconds to 5 minutes. In an embodiment, the pulp can be at a pressure of 3-5 bars at a temperature greater than 100° C. for 30 seconds to 4 minutes. In an embodiment, the pulp can be at 3 to 4 bars at a temperature of between 120° C. to 160° C. for 2-4 minutes.

The plug of pulp can exit the steam tube via any standard piece of equipment sufficient to release the pressure and cool the material. The pulp can exit via any typical device that relieves pressure, including for example, equipment that has a pressure relief valve, a blow valve, a disintegrator operating at atmospheric pressure, or a disk refiner operating at atmospheric pressure. The release of pressure on the plug as it exits the steam tube leads to some adiabatic cooling of the pulp, along with subsequent release of steam. In an embodiment, the plug can be depressurized to atmospheric pressure, i.e. about 1 bar. In an embodiment, the temperature of the plug can be reduced to less than about 100° C., less than about 90° C., or less than about 80° C.

Alternatively, the plug of pulp can exit the steam tube and be further processed at elevated temperature and pressure before being depressurized. For example, after processing the pulp in the plug screw and steam tube, the pulp can be further treated in a disk refiner, such as disclosed by U.S. Pat. No. 6,899,790, herein incorporated by reference in its entirety. Pulp exiting the steam tube can enter the disk refiner at an elevated temperature and elevated pressure, thus imparting additional mechanical action to the pulp at the refining gap of the disk refiner. The material could then exit the disk refiner via a device or other process equipment that releases the steam pressure of the pulp, and be further processed and crosslinked as in this disclosure.

After exiting the plug screw and steam tube, the pulp can be described as a mechanically processed chemical pulp. The mechanically processed chemical pulp can be a medium-curl pulp. The mechanically processed pulp can have an elevated curl index of at least about 0.2, at least about 0.23, at least about 0.25, or at least about 0.29. The mechanically processed pulp can have a curl index at least about 30%, at least about 40% or at least about 50% higher than the curl index of the starting pulp. The mechanically processed pulp have a curl index at least about 60%, at least about 70%, or at least about 80%

In general, the term curl index or curl index value refers to the length weighted curl index. Curl index is measured for fibers according to standards used in the industry. The curl index is typically measured with a Fiber Quality Analyzer, such as an instrument by OpTest. Generally the curl index (length weighted, unless otherwise specified) is determined by standard procedures. The curl index is determined by measuring individual fiber contours and projected lengths using optically imaged fibers, such as with a CCD camera and polarized infrared light. The curl index, CI, is determined by:

$$CI = \frac{L}{l} - 1$$

where L=contour length and l=projected length. The length weighted curl index (LWCI) is calculated by multiplying the sum of the individual CI by its contour length and dividing by the summation of the contour lengths:

$$LWCI = \frac{\sum_i CI_i * L_i}{\sum_i L_i}$$

where $CI_i$=individual arithmetic curl index and $L_i$=individual contour length.

In an embodiment of the disclosure, the mechanically processed chemical pulp can be treated with a crosslinking agent, and the treated crosslinked pulp can be dried to produce the high curl pulp. The crosslinking agent can be any crosslinking agent suitable for crosslinking pulp, including urea-based crosslinkers, dialdehyde crosslinkers, glyoxal-urea adducts, polycarboxylic acids, and polymeric polycarboxylic acids. Non-limiting examples include the lists of crosslinking agents in U.S. Pat. No. 7,018,508 and references cited therein, which are incorporated herein by reference in their entireties. In an embodiment, the crosslinking agent can be glutaraldehyde or citric acid. The crosslinking agent can be added in an amount of at least 0.5% crosslinking agent to wood pulp, based on weight of crosslinking agent to the total weight of the solids. In an embodiment, the crosslinking agent can be added in an amount of about 0.5% to about 10% by weight, about 1% to about 10% by weight, about 1% to about 8% by weight, about 1% to about 6% by weight, about 1% to about 5%, about 2% to about 6% by weight, or about 3% to about 6%.

In an embodiment, the crosslinking agent can be citric acid (including salts of citric acid.) The citric acid can be added in an amount at least about 0.5% by weight, or in an amount of about 0.5-10% by weight, or in the amounts further described above. In an embodiment the crosslinking agent can include citric acid and further include a hypophosphite. In an embodiment, the crosslinking agent can include citric acid, a hypophosphite, and a base, preferably citric acid, sodium hypophosphite and sodium hydroxide. The ratio of citric acid to hypophosphite to base can be about 1 citric acid to 0.2-0.4 hypophosphite to 0.05 to 0.15 base, i.e. 1:0.2-0.4:0.05-0.15. Preferably the ratio can be about 1:0.3:0.1.

The ratio of citric acid:hypophosphite:base is based on weight ratios of solids, assuming that the components are citric acid:sodium hypophosphite:sodium hydroxide. However, other compounds might be used that can still fulfill the chemical reactivity required. For example, instead of sodium hydroxide (MW=40), a person of ordinary skill could substitute potassium hydroxide (MW=56), and would recalculate the amount of base needed as 1.4 times higher, based on conversion 1 equivalent NaOH/40=x equivalents KOH/56. Similarly, other bases or other hypophosphites could be used. Moreover, citric acid and a base can react to form a citrate salt, such as with citric acid and sodium hydroxide to form sodium citrate having up to three sodiums per citrate depending on the number of acid groups neutralized. Thus, the ratio above also is intended to describe a ratio of components even when a citrate salt is used in place of, or a partial replacement of, citric acid and/or a base. One of ordinary skill would understand how to convert the molecular weights of components to apply to the weight ratio provided above.

After addition of the crosslinking agent, the processed pulp can be dried. The drying can occur in any drying apparatus. In an embodiment the processed pulp can be dried in a flash drier. In an embodiment, the processed pulp with the crosslinking agent can be dried at a temperature of at least about 80° C., at least about 90° C. or at least about 100° C. The processed pulp with the crosslinking agent can be dried at a temperature above 100° C., about 110° C. or above 120° C.

The crosslinked processed pulp can also be cured. By "cured" is meant a final drying process that reduces the water level to less than 10% water, less than 8% water, or less than 6% water. "Cured" can also indicate that the chemical crosslinking is substantially complete, such as at least about 75% complete, 80% complete, 85% complete, 90% complete, or 95% complete. The crosslinked processed pulp can be cured at about 140° C. or greater, at about 150° C. or greater, at about 160° C. or greater, at about 170° C. or greater. The processed pulp can be cured at a temperature of about 140 to 200° C., about 150 to 200° C., or about 160 to 200° C. The curing time can decrease as the curing temperature increases. For example, the crosslinked processed pulp can be cured at about 150° C. for 15-20 minutes. The crosslinked processed pulp can also be cured at about 180° C. for about 5-10 minutes.

Depending on the process scheme, the drying temperature and the curing temperature can be the same temperature or different temperatures. For example, the pulp can be dried in a flash dryer, where the air in the flash dryer operates at between 170 and 200° C., and then the dried pulp can be cured in an oven at 170 to 200° C. Alternatively, the air temperature in the flash dryer could be higher or lower than the air temperature during curing. Moreover, one of ordinary skill would recognize that the internal temperature of the pulp can be different than the air temperature. For example, the internal temperature of the pulp in the flash dryer operating at an air temperature of 170-180° C. could typically be below 100° C., for example around 60 or 70° C., due to the evaporative cooling of water as it is being driven off from the pulp. Similarly the internal temperature of the pulp in a curing oven could be higher compared to the pulp in the drying stage as the residual water is driven out and the pulp cured.

Note that the crosslinking agent is described as treating the mechanically processed pulp. This can imply that the crosslinking agent is added after the pulp is mechanically processed. In an embodiment, the crosslinking agent can be added to the mechanically processed pulp. However, crosslinking of the pulp is not completed until a final drying step, and thus the crosslinking agent can be added to the pulp at any point in the process prior to the final drying, or at any point prior to drying at elevated temperatures. The crosslinking agent can be added to the pulp before it enters the plug screw, after it enters the plug screw, or as it exits the plug screw. In some embodiments, the process can include a drying step prior to elevated temperatures, such as in a flash dryer, and the crosslinking agent can be added during the flash drying step. Preferably, the crosslinking agent is added after the pulp enters the plug screw.

The use of a crosslinking agent on wood products is not unknown. However, the use of a crosslinking agent on mechanically processed chemical pulp can achieve high curl pulps. By driving the crosslinking process on a mechanically treated pulp to completion at higher temperatures in a curing oven, new high curl pulps can be created. The mechanically treated pulp can be preferably the mechanically processed pulps from the steam tube and plug screw, discussed above. However, additional mechanical treatments of pulp, such as for example U.S. Pat. No. 6,899,790 or U.S. Pat. No. 7,390,378, can be used in combination with the crosslinking agent cured in the oven. Thus, an embodiment of the disclosure can be a process for preparing a high-curl pulp, include mechanically treating a chemical pulp, applying a crosslinking agent and curing the crosslinked wood pulp at a temperature of at least about 140° C. to produce the high-curl pulp. The crosslinking agents and conditions can be analogous to the conditions discussed above.

Crosslinked processed pulp that is to be cured can be cured at a range of densities. The pulp can be cured as a loose pulp collected from the process, for example from a cyclone or dryer. The pulp can also be collected as a pad from a collecting device, for example an airlaid pad, and the pad can be cured. The pad can have a density of less than about 0.2 g/cc (i.e. 200 kg/m$^3$.) The pad can have a density of greater than about 0.02 g/cc. The density can be between about 0.02 to about 0.2 g/cc, between about 0.02 to about 0.1 g/cc, between about 0.02 to about 0.08 g/cc, between about 0.04 to about 0.1 g/cc, or between about 0.04 to about 0.08 g/cc.

With the disclosed process, a high curl pulp can be prepared that has curl indices of at least greater than 0.35. In an embodiment, the high curl index can be at least about 0.40, at least about 0.42, at least about 0.43, at least about 0.45, at least about 0.46, at least about 0.48 or at least about 0.50. Furthermore, the high curl index can described based on the increase in curl index achieved by the process. In an embodiment, the final curl index can be at least 50% higher than the initial curl index, at least 75% higher, or at least 90% higher. In preferred embodiments, the curl index can be 100% higher than the initial curl index of the pulp, at least 125% higher, at least 150% higher, at least 200% higher, at least 250% higher, or at least 300% higher. The disclosed process can in fact lead to more than doubling, more than tripling, or more than quadrupling the curl index of the starting material.

With the disclosed process, high curl pulps can be achieved that have not been observed in our testing of commercial samples. The high curl pulp can be applied to a variety of products, including particularly absorbent sheets or materials, and particularly acquisition and distribution layers requiring high loft bulk, which is at least partially maintained after wetting. In an embodiment, an absorbent sheet or an acquisition and distribution layer can include a citric acid-crosslinked mechanically treated pulp fiber. The fiber can have a curl index of at least 0.40, at least about 0.42, at least about 0.43, at least about 0.45, at least about 0.48 or at least about 0.50. The fiber can have a citric acid content of at least about 0.5% by weight, from about 0.5% to about 5% by weight, from about 1% to about 5% by weight, or from about 1% to about 3% by weight. The absorbent sheet or the acquisition and distribution layer can have a fiber with a curl index of at least about 0.45 and the citric acid content of at least about 0.5 wt %, a fiber with a curl index of at least about 0.45 and the citric acid content of at least about 1 wt %, or a fiber with a curl index of at least about 0.45 and the citric acid content of at least about 3 wt %.

The method of this disclosure also produces a pulp with exceptionally low water retention values (WRV.) Water retention value is typically measured in the industry using TAPPI Method UM256. In many products such as diapers, an absorbent pad typically consisting of pulp fibre and superabsorbent is used to absorb liquid insults. This absorbent pad can sometimes not absorb the insult rapidly enough at the point of insult due to gel blocking or other limitations of pad, which leads to leaks. To reduce leakage a layer is added on top of the absorbent pad commonly referred to as an acquisition and distribution layer (ADL). This ADL spreads the insult in the x-y plane of the layer increasing the area of the absorbent pad below that is exposed to the insult. This in turn reduces gel blocking and reduces the potential for leakage. In this disclosure, crosslinked mechanically treated pulp used in the ADL can have a water retention value of less than about 0.30, less than about 0.28, or less than about 0.25, as measured according to TAPPI Method UM256.

The disclosure is further exemplified by the following non-limiting examples.

EXAMPLES

Example 1

Mechanical Treatment

A softwood Kraft pulp prepared using a conventional Kraft process was used to produce a pulp containing 2-10% solids, and was thickened to about 20-45% solids using a Thune press. The pulp was then fed into a plug screw and steam tube for two to four minutes at 3.5 to 4 bars of steam pressure. The resulting pulp was disintegrated for 5 minutes and the curl index and kinks/mm measured. The results are shown in Table 1.

TABLE 1

| Sample | Steaming Time (min) | Refining Sp. Energy (kWh/t) | Length weighted curl index[1] | Kinks per mm (1/mm)[1] |
|---|---|---|---|---|
| A | 4 | 0 | 0.26 | 1.38 |
| B | 2 | 0 | 0.27 | 1.38 |
| C | 2 | 80 | 0.26 | 1.29 |

[1]Samples were disintegrated in the British disintegrator for 5 minutes (Standard PAPTAC method)

Example 2

Crosslinking Tests

In order to evaluate crosslinking, a crosslinker and catalyst were added to an original never-dried pulp and mixed to a uniform consistency of 15%. The mixture was then air-dried to a 50% pulp consistency, the fibers manually separated in the air dried samples, and then cured in an oven for 45 minutes at 140° C. Crosslinkers were added at 0.5%, 1.0% and 2% by weight of pulp, and 30 wt % (based on crosslinker) of a catalyst for the crosslinker was added. Citric acid with sodium hypophosphite (Table 2) and glutaraldehye with zinc nitrate (Table 3) were evaluated.

TABLE 2

| Citric acid (wt % on pulp) | Length weighted curl index | Kinks per mm (1/mm) | Length weighted length (mm) |
|---|---|---|---|
| 0 (never dried pulp) | 0.19 | 1.10 | 2.28 |
| 0 (+heat treatment) | 0.26 | 1.35 | 2.12 |
| 0.5 (+heat treatment) | 0.29 | 1.41 | 2.06 |
| 1.0 (+heat treatment) | 0.31 | 1.46 | 2.08 |
| 2.0 (+heat treatment) | 0.33 | 1.46 | 2.03 |

TABLE 3

| Glutaraldehyde (wt % on pulp) | Length weighted curl index | Kinks per mm (1/mm) | Length weighted length (mm) |
|---|---|---|---|
| 0 (never dried pulp) | 0.19 | 1.10 | 2.28 |
| 0 (+heat treatment) | 0.26 | 1.35 | 2.12 |
| 0.5 (+heat treatment) | 0.29 | 1.44 | 2.02 |
| 1.0 (+heat treatment) | 0.30 | 1.44 | 2.04 |
| 2.0 (+heat treatment) | 0.34 | 1.52 | 1.96 |

All treated pulps in Tables 2 and 3 were disintegrated for 25 minutes before evaluating the parameters.

Example 3

Mechanical-Crosslinking Tests

A series of samples were prepared in which never-dried kraft pulp was treated under a range of conditions, including untreated original pulp and mechanically treated pulp each of which were measured without any additional crosslinking or heat treatment, heat treating at 145° C. for 45 minutes, and crosslinking with citric acid followed by heat treating. The combination of mechanical treating and chemical crosslinking provides the highest curl index, as shown in Table 4. All the pulps were disintegrated for 25 minutes before evaluating the parameters.

TABLE 4

| | Length weighted curl index | Kinks per mm (1/mm) | Length weighted length (mm) |
|---|---|---|---|
| Original pulp | | | |
| Untreated | 0.19 | 1.10 | 2.28 |
| Heat treatment 0 wt % citric acid | 0.26 | 1.35 | 2.12 |
| Heat treatment 1.0 wt % citric acid | 0.32 | 1.48 | 2.04 |
| Mechanically treated pulp | | | |
| Untreated | 0.29 | 1.42 | 1.99 |
| Heat treatment 0 wt % citric acid | 0.39 | 1.61 | 1.90 |
| Heat treatment 1.0 wt % citric acid | 0.45 | 1.68 | 1.75 |

Figure 4:
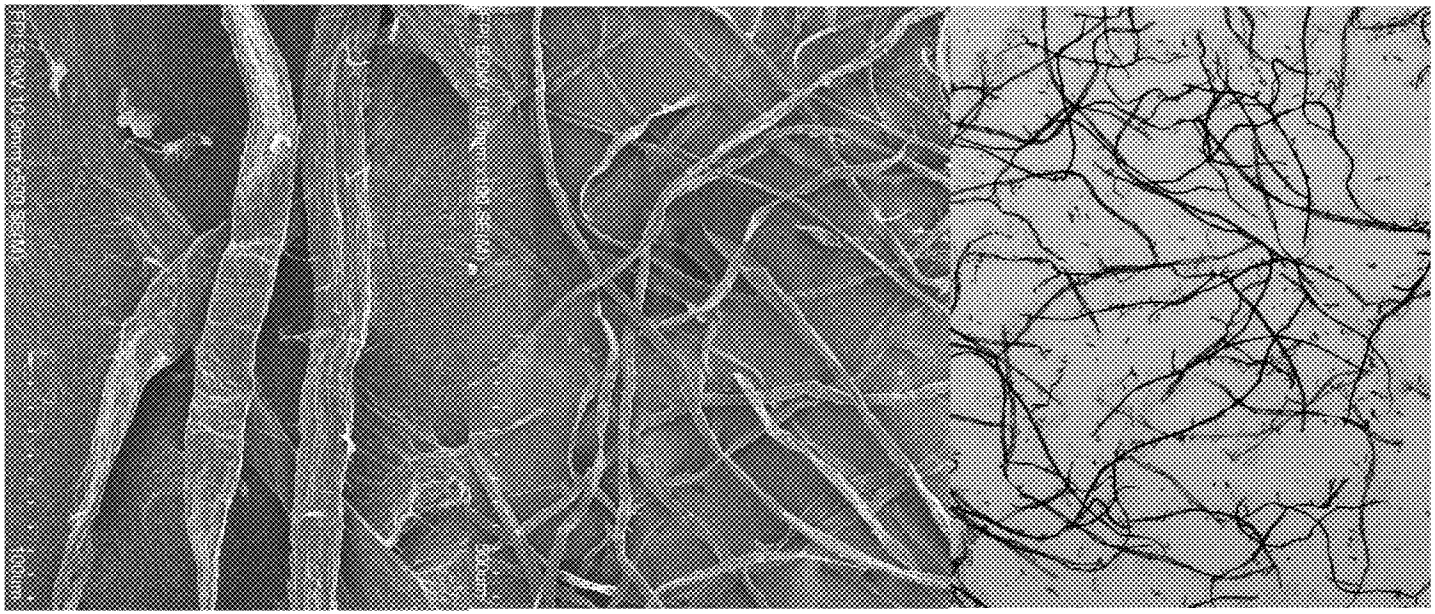
FIG. 4 illustrates a series of photomicrograph at three different levels of magnification of untreated pulp, in accordance with some embodiments of the disclosure.
Figure 5:
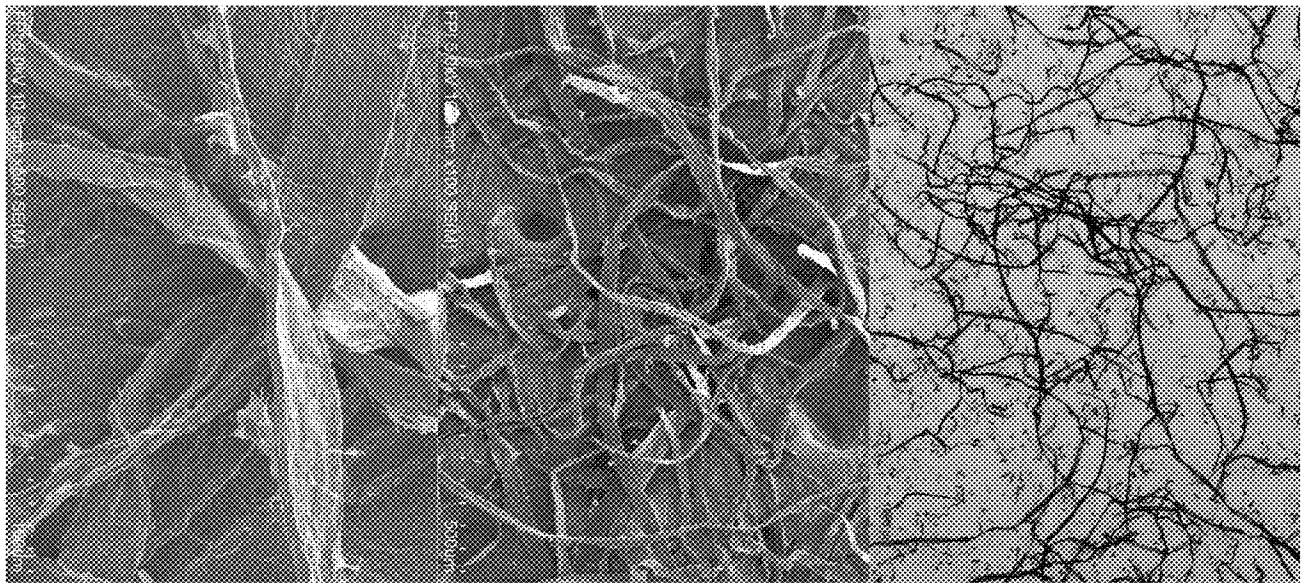
FIG. 5 illustrates a series of photomicrograph at three different levels of magnification of untreated pulp that has been dried, in accordance with some embodiments of the disclosure.
Figure 6:
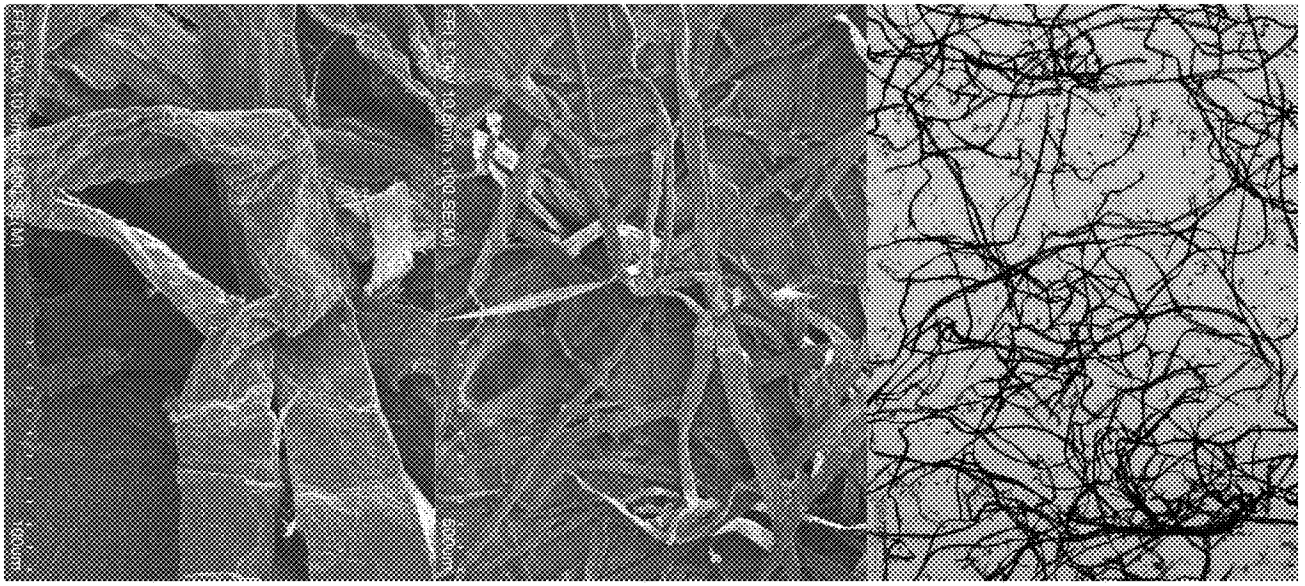
FIG. 6 illustrates a series of photomicrograph at three different levels of magnification of pulp treated with 1% citric acid and dried, in accordance with some embodiments of the disclosure.
Figure 7:
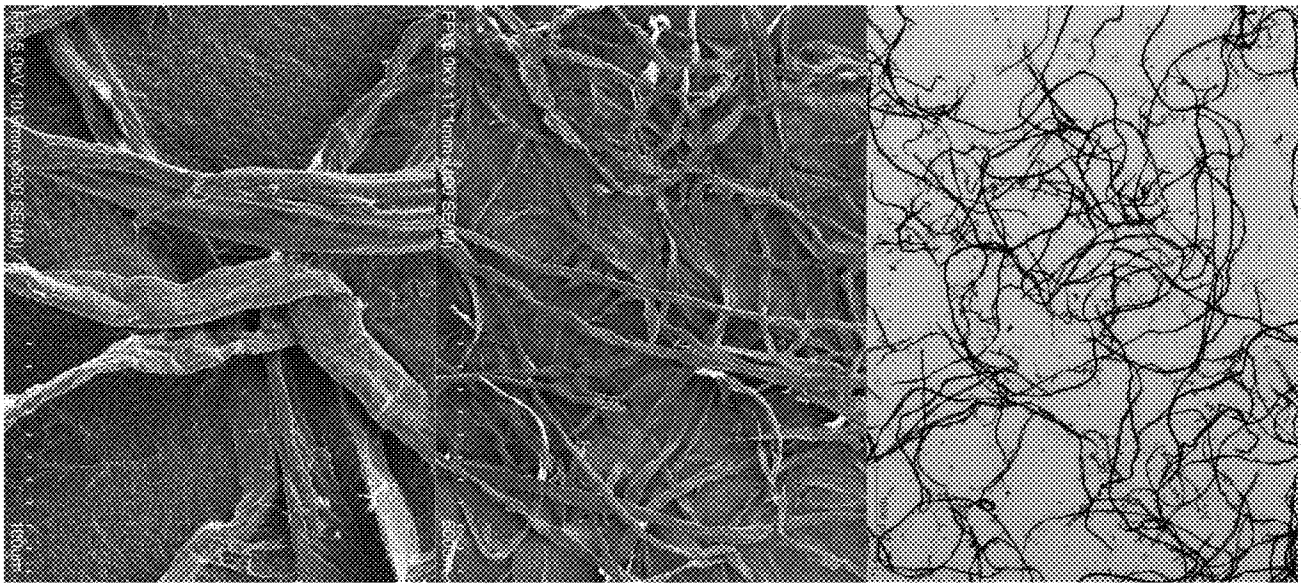
FIG. 7 illustrates a series of photomicrograph at three different levels of magnification of mechanically processed pulp that has not been dried, in accordance with some embodiments of the disclosure.
Figure 8:
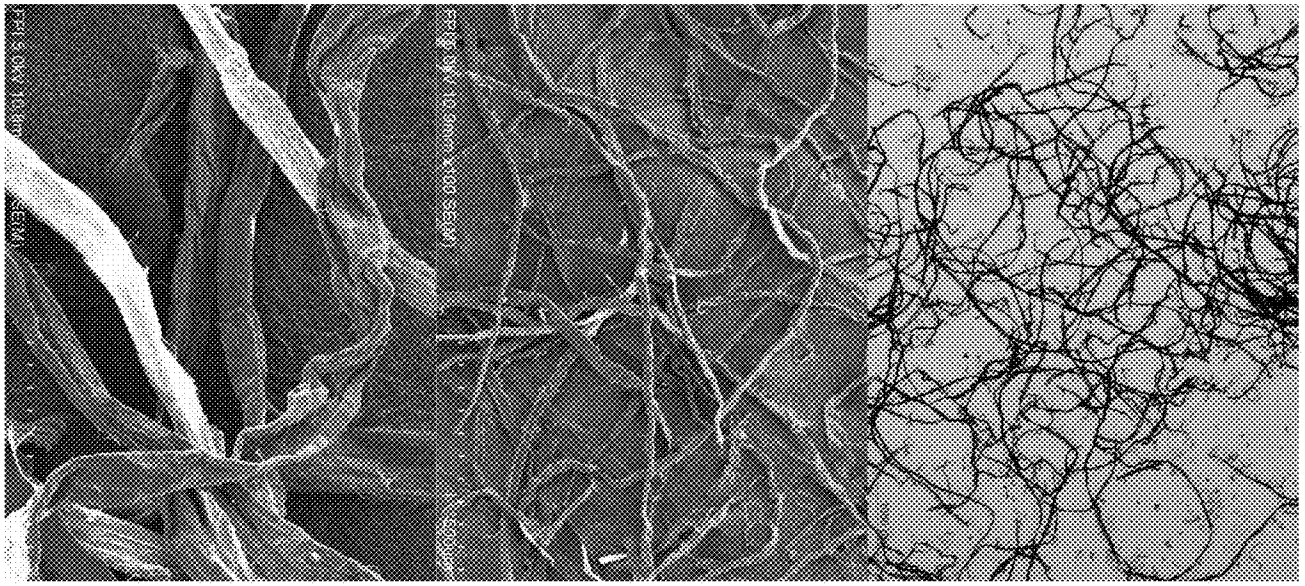
FIG. 8 illustrates a series of photomicrograph at three different levels of magnification of mechanically processed pulp that has been dried, in accordance with some embodiments of the disclosure.
Figure 9:
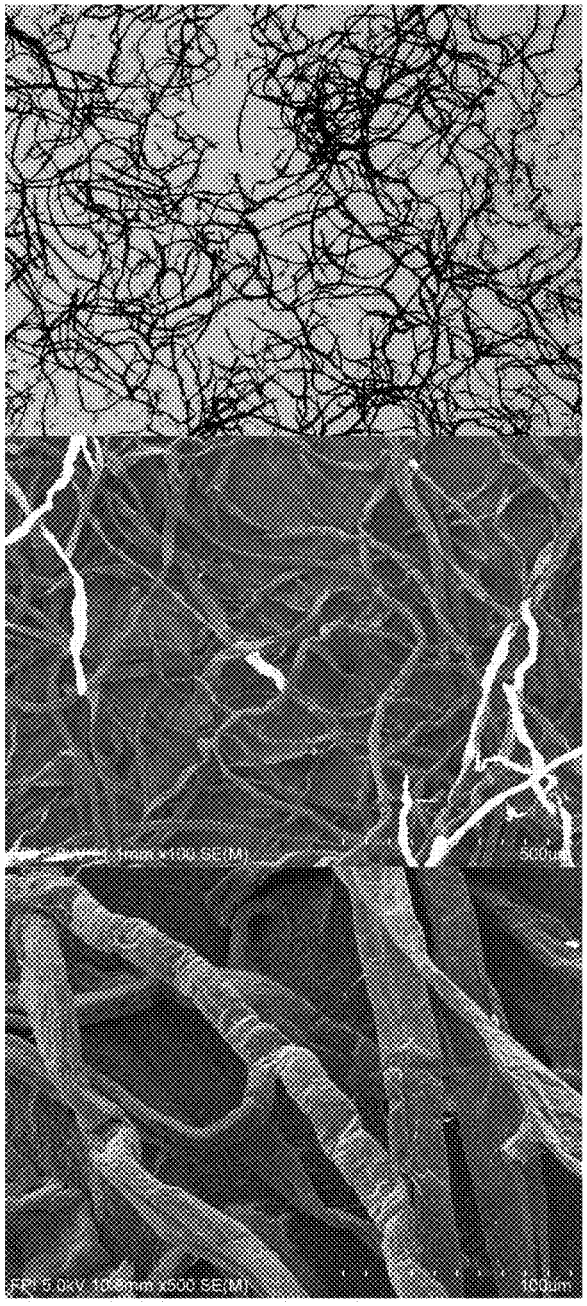
FIG. 9 illustrates a series of photomicrograph at three different levels of magnification of mechanically processed pulp with 1% citric acid that has been dried, in accordance with some embodiments of the disclosure.

Scanning electron micrographs of each of the six samples about are presented in FIGS. 4-9. Each of the samples is shown at three different levels of magnification, with the scale bar in the lower right corner of each image for 1000 μm, 500 μm, and 100 μm. FIG. 4 shows the untreated pulp. FIG. 5 shows original pulp with heat treatment only. FIG. 6 shows original pulp with only citric acid crosslinking and heat treatment, but no mechanical treatment. FIG. 7 shows mechanically treated pulp. FIG. 8 shows mechanically treated pulp with heat treatment, but no crosslinking FIG. 9 shows mechanically treated pulp with 1% citric acid and heat treatment.

The treated, crosslinked product of Example 3 exhibits higher curl values than current products on the market. One market product has a curl index of 0.41, a kinks per mm of 1.60, and a length weighted length of 2.32.

Example 4

Comparison of Mechanical and Chemical Steps for Crosslinking

A series of lab scale and pilot plant production runs were conducted using a southern bleached softwood kraft pulp from a mill Various steps and process conditions were included or excluded to demonstrate the effectiveness of the method at achieving a high curl index fiber. As an overall process description, a wood pulp was received that could be used wet, or could be previously dried and reslurried. The pulp could be fed by plug screw into a steam tube, and mechanically treated at a pressure of 3.5 bars and 120 to 160° C. The residence time in the steam tube was typically 2 minutes. The pulp could be treated with a citric acid as a crosslinking agent, measured as a % wt of dry citric acid to dry wood pulp. The pulp could be flash dried to a moisture level of 4-10%, and optionally later oven dried, including being cured in an oven. The pulp could be oven dried at 170-180° C. for about 4 to 5 minutes. The pulp could be oven dried as a loose mass, or could be collected via an air-laying device as a pad at 200 g/m$^2$ and 0.02 g/cm$^3$. Fiber webs of 100 g/m$^2$ to 4000 g/m$^2$ have been created and cured, with densities typically around 0.04 g/cm$^3$.

For measuring the product's characteristics, materials were subjected to a disintegrator at 5 minutes or 25 minutes, according to Method Standard C. 9P and Standard C. 10, as revised in June 2006 by the Standards Testing Committee of the Pulp and Paper Technical Association of Canada. Fiber characteristics were measured according to Technical Association of the Pulp and Paper Industry method T271 om-02, as revised in 2002. Each of these methods are incorporate by reference as if set forth in their entirety. Water Retention Values (WRV) were measured according to TAPPI Method UM256.

The first set of tests are set forth in Table 5. Example 1 was a wet pulp that was not dried. Examples 2 and 3 were a pulp dried to about 10% moisture that was reslurried prior to treatment. Example 4 and 5 were dried reslurried pulps that were mechanically treated, with no subsequent drying. Example 6 was a dried reslurried pulp that was mechanically treated and dried in a flash drier. Examples 7 and 8 were a dried reslurried pulp with 5% crosslinker that were not mechanically treated, and dried in a flash drier. Examples 9 and 10 were a dried reslurried pulp with 5% crosslinker that were not mechanically treated, and were dried in a flash drier, followed by oven drying at 180° C. for 5 minutes.

TABLE 5

| Ex. | Sample | Disinteg. Time | WRV | Length $L_w$ mm | Curl $L_w$ | Kink per mm | Fines % |
|---|---|---|---|---|---|---|---|
| 1 | CTW | 25 | 0.835 | 2.68 | 0.166 | 0.82 | 35.31 |
| 2 | CTD | 5 | 0.627 | 2.45 | 0.232 | 1.17 | 36.44 |
| 3 | CTD | 25 | 0.623 | 2.46 | 0.193 | 1.01 | 38.84 |
| 4 | CTDM-000, no FD | 5 | 0.644 | 2.11 | 0.384 | 1.56 | 38.51 |
| 5 | CTDM-000, no FD | 25 | 0.716 | 2.20 | 0.337 | 1.48 | 35.66 |
| 6 | CTDM-000, after FD | 25 | 0.738 | 2.23 | 0.307 | 1.42 | 36.95 |
| 7 | CTD-050-FD | 5 | 0.706 | 2.52 | 0.214 | 1.09 | 37.22 |
| 8 | CTD-050-FD | 25 | 0.729 | 2.50 | 0.198 | 0.98 | 37.41 |
| 9 | CTD-050-FD - OD3 | 5 | 0.216 | 1.81 | 0.480 | 1.75 | 23.28 |
| 10 | CTD-050-FD - OD3 | 25 | 0.248 | 1.79 | 0.482 | 1.76 | 25.73 |

A second set of tests are set forth in Table 6. Samples here were subjected to the 25 minute disintegration, unless otherwise indicated. Example 11 was a dried reslurried mechanically treated pulp with no crosslinking that was flash dried to produce a loose material. Example 12 was a dried reslurried mechanically treated pulp with no crosslinking that was flash dried, airlaid, and oven dried at 170° C. for 4 minutes. Example 13 was a dried reslurried mechanically treated pulp with 3% crosslinker that was flash dried and ovendried at 180° C. for 5 minutes as a loose material. Example 14 was a dried reslurried mechanically treated pulp with 3% crosslinker that was flash dried, airlaid into a pad, and oven dried at 170° C. for 4 minutes. (5 minute disintegration only). Example 15 was a dried reslurried mechanically treated pulp with 3% crosslinker that was flash dried, airlaid into a pad, and oven dried at 170° C. for 4 minutes. Example 16 was a dried reslurried mechanically treated pulp with 3% crosslinker that was flash dried, and oven dried at 170° C. for 4 minutes as a loose material. Example 17 was a dried reslurried mechanically treated pulp with 5% crosslinker that was flash dried, and oven dried at 180° C. for 5 minutes as a loose material. Example 18 was a dried reslurried mechanically treated pulp with 5% crosslinker that was flash dried, and oven dried at 170° C. for 4 minutes as a loose material. Example 19 was a dried reslurried mechanically treated pulp with 5% crosslinker that was flash dried, airlaid into a pad, and oven dried at 170° C. for 4 minutes. Examples 20, 21, and 22 were a dried reslurried mechanically treated pulp with 1.5%, 3% and 5% crosslinker, respectively, that was flash dried and oven dried at 180° C. for 5 minutes as a loose material. Example 23 was a wet pulp that was not previously dried, mechanically treated with a 5% crosslinker, and flash dried and oven dried at 180° C. for 5 minutes as a loose material

TABLE 6

| No. | Sample-Treatment | Dosage | WRV | Length Lw mm | Curl $L_w$ | Kink | Fines % |
|---|---|---|---|---|---|---|---|
| 11 | CTDM-000-FD-loose | 0 | 0.788 | 2.20 | 0.328 | 1.43 | 39.28 |
| 12 | CTDM-000-OD4-pad | 0 | 0.671 | 2.34 | 0.295 | 1.47 | 28.17 |
| 13 | CTDM-030-OD3-loose | 3% | 0.298 | 1.80 | 0.509 | 1.78 | 27.05 |
| 14 | CTDM-030-OD4-pad (5 min dist. curl only) | 3% | | 1.91 | 0.515 | 1.78 | 18.64 |
| 15 | CTDM-030-OD4-pad | 3% | 0.298 | 1.91 | 0.499 | 1.75 | 18.58 |
| 16 | CTDM-030-OD4-loose | 3% | 0.388 | 1.85 | 0.504 | 1.77 | 37.15 |
| 17 | CTDM-050-OD3-loose | 5% | 0.268 | 1.54 | 0.525 | 1.81 | 36.73 |
| 18 | CTDM-050-OD4-loose | 5% | 0.323 | 1.79 | 0.526 | 1.80 | 30.29 |
| 19 | CTDM-050-OD4-pad | 5% | 0.265 | 1.98 | 0.530 | 1.81 | 10.99 |
| 20 | CTDM-015-OD3-loose | 1.5% | 0.413 | 1.94 | 0.457 | 1.75 | 33.84 |
| 21 | CTDM-030-OD3-loose | 3% | 0.293 | 1.61 | 0.489 | 1.80 | 43.18 |
| 22 | CTDM-050-OD3-loose | 5% | 0.250 | 1.33 | 0.478 | 1.75 | 42.50 |
| 23 | CTWM-050-OD3-loose | 5% | 0.241 | 1.12 | 0.459 | 1.75 | 49.81 |

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based can be readily utilized as a basis for the design of other structures, methods, and systems for carrying out the several purposes of the embodiments and claims presented in this application. It is important, therefore, that the claims be regarded as including such equivalent constructions.

We claim:

1. A process for preparing a high-curl kraft pulp, comprising mechanically treating a chemical pulp by passing pulp through a plug screw passing the pulp through a steam tube in less than about 6 minutes;

pressurizing the pulp while in the plug screw with steam at a temperature above 100° C. and a pressure greater than 2bar;

treating the mechanically processed kraft pulp with a crosslinking agent;

drying the processed kraft pulp at a temperature above 100° C.; and curing the processed kraft pulp at a temperature of at least about 140° C. to produce the high-curl pulp.

2. The process of claim 1, wherein the pulp is at a pressure greater than 3 bar.

3. The process of claim 1, wherein the pulp is at a pressure of 3 to 5 bar.

4. The process of claim 1, wherein the pulp resides in the steam tube for 30 seconds to 5 minutes.

5. The process of claim 1, wherein the pulp resides in the steam tube for about 30 seconds to 4 minutes.

6. The process of claim 1, wherein the pulp resides in the steam tube for about 2 to 4 minutes.

7. The process of claim 1, wherein the pulp is at a pressure of 3-5 bars at a temperature greater than 100° C. for 30 seconds to 4 minutes.

8. The process of claim 1, wherein the crosslinking agent is selected from the group consisting of citric acid and glutaraldehyde.

9. The process of claim 8, wherein the pulp is treated with citric acid in an amount of 0.5% to 10% by weight to the kraft pulp solids content.

10. The process of claim 9, wherein the pulp is treated with citric acid in an amount of 1 to 5% by weight to the kraft pulp solids content.

11. The process of claim 1, wherein the pulp is treated with a crosslinking agent in an amount of 0.5% to 10% by weight of a kraft pulp solids content.

12. The process of claim 1, wherein the high curl kraft pulp has a final curl index of at least about 0.35.

13. The process of claim 1, wherein the high curl kraft pulp has a final curl index of at least about 0.40.

14. The process of claim 1, wherein the curing temperature is at least about 150° C.

15. The process of claim 1, wherein the high curl kraft pulp has a final curl index at least 100% higher than an initial curl index of the chemical pulp.

16. The process of claim 1, wherein the high curl kraft pulp has a final curl index at least 150% higher than an initial curl index of the chemical pulp.

17. The process of claim 1, wherein the high curl kraft pulp has a final curl index at least 200% higher than an initial curl index of the chemical pulp.

18. The process of claim 1, wherein the high curl kraft pulp has a final curl index of at least about 0.43.

19. The process of claim 1, wherein the high curl kraft pulp has a final curl index of at least about 0.46.

* * * * *